US008146264B1

(12) United States Patent
Stefano et al.

(10) Patent No.: US 8,146,264 B1
(45) Date of Patent: Apr. 3, 2012

(54) CORDLESS HAIR DRYER DEVICE

(76) Inventors: Robert Stefano, Coral Gables, FL (US); Daphne S. Parker, Coral Gables, FL (US)

( * ) Notice: Subject to any disclaimer, the term of this patent is extended or adjusted under 35 U.S.C. 154(b) by 768 days.

(21) Appl. No.: 12/209,312

(22) Filed: Sep. 12, 2008

Related U.S. Application Data

(60) Provisional application No. 60/993,699, filed on Sep. 12, 2007.

(51) Int. Cl.
*A45D 20/12* (2006.01)
*A45D 20/10* (2006.01)

(52) U.S. Cl. ..... 34/96; 34/97; 392/383; 392/384; 392/385

(58) Field of Classification Search ..... 34/97, 96; D13/103; 219/222; 320/112, 114, 116; 392/383, 392/384, 385; 429/8, 96, 99, 149
See application file for complete search history.

(56) References Cited

U.S. PATENT DOCUMENTS 5,805,423 A * 9/1998 Wever et al. ..... 361/760
6,718,651 B2 * 4/2004 Perez et al. ..... 34/96
7,428,785 B2 * 9/2008 Kim ..... 34/96
2005/0153195 A1 * 7/2005 Han ..... 429/59
2007/0022563 A1 * 2/2007 Wu ..... 15/344
2008/0042492 A1 * 2/2008 Gleason et al. ..... 307/66
2008/0211309 A1 * 9/2008 Nolte ..... 307/66
2008/0216339 A1 * 9/2008 Gray ..... 34/97
2011/0091755 A1 * 4/2011 Kuroda et al. ..... 429/94

* cited by examiner

*Primary Examiner* — Kenneth Rinehart
*Assistant Examiner* — John McCormack
(74) *Attorney, Agent, or Firm* — David P. Lhota, Esq.; Malin Haley DiMaggio Bowen & Lhota, P.A.

(57) ABSTRACT

A cordless hair dryer device comprising an ergonomically shaped handle, air cone, rechargeable lithium-type battery pack that releasably attaches to a battery mount on the back of the hair dryer, temperature controls, blower speed controls, DC motor, heater and battery pack charger. The handle is ergonomically designed for balance and comprises the heat and blower controls for convenient access and use. The heater comprises a tourmaline impregnated ceramic heater. Intake air flows over the tourmaline/ceramic heater producing negative ions so the hair does not become statically charged during the drying process. The air intake at the back of the hair dryer includes a removable filter to catch errant fibers and hair before they flow into the blower/heater area. The motor and tourmaline impregnated ceramic heater are mounted close to the battery pack in a manner that provides easier control.

6 Claims, 2 Drawing Sheets

CORDLESS HAIR DRYER DEVICE

CROSS REFERENCE TO RELATED APPLICATIONS

This application claims the benefit of provisional patent application Ser. No. 60/993,699 filed Sep. 12, 2007.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a hair dryer, and more particularly, to a cordless hair dryer and styling product that reduces clutter and cord tangles and allows the hair stylist more freedom of movement.

2. Description of the Background Art

In the typical stylist's station, several corded products are plugged into one or more electrical outlets, such as hair dryers, electric clippers, electric shears and curling irons to name a few. During use, the cords invariably become tangled during use and must be detangled, which normally involves unplugging the cords, sorting the cords out, and re-plugging them into the electrical outlets. Another problem is that the length of a cord can prevent the stylist from freely moving while styling a client's hair without repositioning the client's chair. If a reliable, lightweight, cordless hair dryer existed it would be well received. However, there are no cordless hair dryers known that adequately address or resolve these issues. Accordingly, there exists a need for a reliable, cordless, lightweight hair dryer. The instant invention disclosed herein addresses these unfulfilled needs in the prior art.

BRIEF SUMMARY OF THE INVENTION

Based on the foregoing, it is a primary object of the instant invention to provide an energy efficient and reliable cordless hair dryer device.

It is another object of the instant invention to provide a cordless hair dryer device that reduces clutter.

It is yet another object of the instant invention to provide a cordless hair dryer device with a rechargeable battery pack.

It is also object of the instant invention to provide a cordless hair dryer device with a rechargeable battery pack that is keyed to prevent improper installation.

It is an additional object of the instant invention to provide a cordless hair dryer device having an ergonomically design handle for balance and operation.

It is a further object of the instant invention to provide a cordless hair dryer device that filters errant fibers, hair and debris.

It is another object of the instant invention to provide a cordless hair dryer device that is energy efficient and cost effective for mass production.

In light of the foregoing, the instant invention teaches a cordless hair dryer device comprising an ergonomically shaped handle, air cone, rechargeable lithium-type battery pack that releasably attaches to the mount on the back of the hair dryer, temperature controls, blower speed controls, DC motor, heater and battery pack charger. The handle is ergonomically designed for balance and comprises the heat and blower controls for convenient access and use. The heater comprises a tourmaline impregnated ceramic heater. Intake air flows over the tourmaline/ceramic heater producing negative ions so the hair does not become statically charged during the drying process. The air intake at the back of the hair dryer includes a removable filter to catch errant fibers and hair before they flow into the blower/heater area. The motor and tourmaline impregnated ceramic heater are mounted close to the battery pack in a manner that provides easier control.

In accordance with these and other objects, which will become apparent hereinafter, the instant invention will now be described with particular reference to the accompanying drawings.

DETAILED DESCRIPTION OF THE INVENTION

Figure 1:
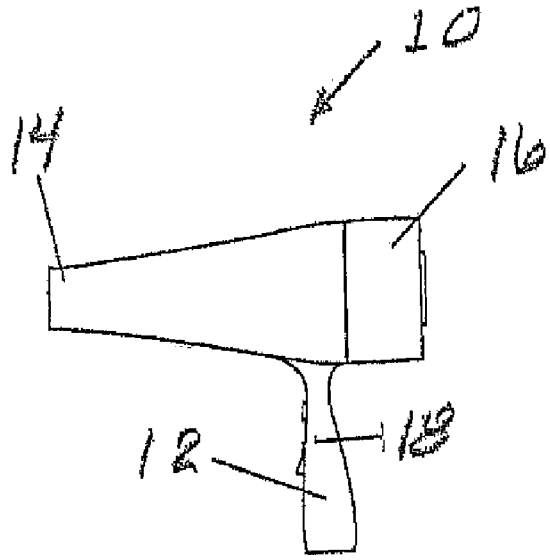
FIG. 1 is an elevational view of the preferred embodiment of the cordless hair dryer device in accordance with the instant invention.

With reference to the drawings, FIGS. 1 to 4 depict the preferred embodiment of the instant invention which is generally referenced as a cordless hair dryer and, or by numeric character 10. The cordless hair dryer 10 is a hair styling product that has been designed to reduce clutter and cord tangles, and allow the hair stylist more freedom of movement.

With reference to FIGS. 1-4, the cordless hair dryer 10 comprises an ergonomically shaped handle 12, air cone 14, battery pack 16 with a mounting key that releasably mounts to the battery mount 15 on the back of the hair dryer 10, heat and blower controls 18, DC motor 20, heater 21 and battery pack charger 30. The key mates with a corresponding mount key comprising an aperture, void or channel on or in the battery mount 15. Alternatively, the key may comprise a void and the mount key may comprise a corresponding projection. The heat and blower controls 18 are secured in the handle 12 and have switches that extend outside the handle 12. The hair dryer 10 is preferably equipped with two control switches that provide 3 heating settings and 2 blower settings plus a system off setting. The blower is controlled with a rocker switch that has high, low and OFF settings. The OFF position is preferably the center position of the blower rocker switch. The OFF position can turn off the heater and the blower to conserve energy. The heater 21 is a tourmaline impregnated ceramic heater. Air flowing over the heater 21 produces negative ions so the hair does not become statically charged. The heater 21 comprises warm, hot and cool settings that are selected with a slide switch. The warm setting consumes about 900 watts/hour, and the hot about 1200 watts/hour. The cordless hair dryer 10 is preferably supplied with three battery packs 16, one charger 30 and nozzle attachments. The hair dryer 10 comprises two concentrator nozzles that are designed to slip over the exit nozzle 14. The air intake at the back of the hair dryer 10 includes a removable lint filter to catch errant fibers and hair before they flow into the blower/heater area. The DC motor and tourmaline impregnated ceramic heater are mounted close to the battery pack. The air flowing over the tourmaline/ceramic heater produces negative ions so the hair does not become statically charged during the drying process. This provides better control and a more optimum styling job.

Figure 2:
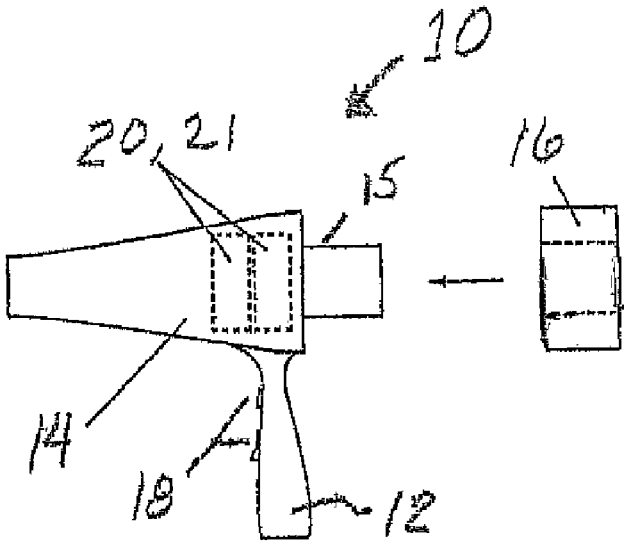
FIG. 2 is an elevational exploded view of the preferred embodiment of the cordless hair dryer device showing the battery pack removed and a DC motor and heater in phantom in accordance with the instant invention.

With reference to FIGS. 1 and 2, the ergonomically shaped handle 12 is positioned and designed to balance the product when the battery pack 16 is in place. The hair dryer 10 and cone 14 comprise a double core wind tunnel housing injection molded from PC-ABS plastic. This plastic is very durable, has excellent resistance to drop shocks, and is typically used in this type of application. The housings can be supplied in almost any tinting color, so a distinctive color may be chosen to enhance the product recognition factor, which can dramatically improve the market adoption of the product. The housing is shaped to allow the seating of the battery packs 16, and to securely hold the heater and DC blower. The molded handle contains the control switches and is shaped to allow and optimum balance in the appliance when the battery pack is installed.

Figure 3:
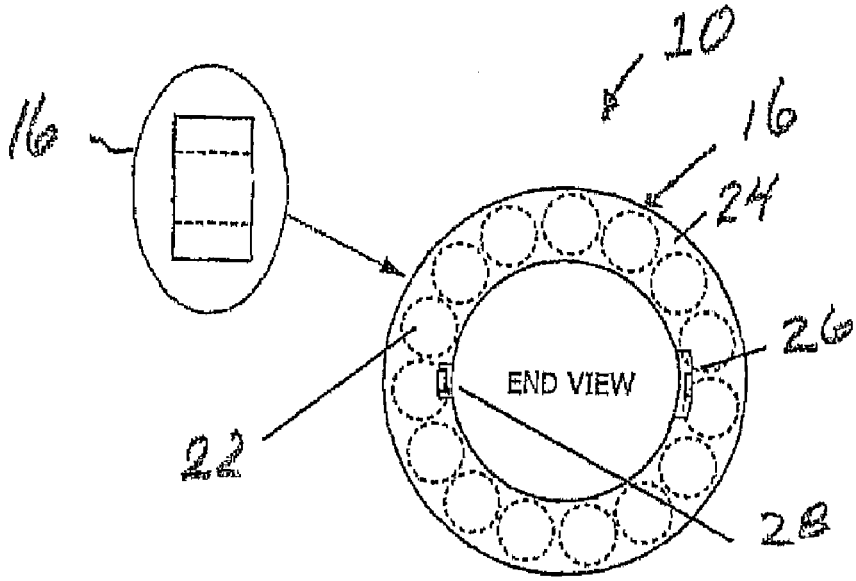
FIG. 3 is an end view of the preferred embodiment of the battery pack of the cordless hair dryer device in accordance with the instant invention.

With reference to FIGS. 2 and 3, the battery pack 16 is a unique ring shaped battery pack that plugs into the rear of the hair dryer 10. The battery pack 16 comprises fifteen Li-ion cells 22 to make approximately 54 VDC battery, wherein the DC motor is wound to operate quietly on this voltage, and a plastic molded case 24 that secures the batteries/cells 22 and prevents damage to them and keys the battery pack 16 to the hair dryer housing 10. The battery pack 16 also comprises contact moldings 26 that securely snap into the hair dryer housing 10 and gold plated contacts 28 that provide a long product life with little to no degradation. The cylindrical battery pack case 24 is molded from polypropylene plastic, securely holds the specially fabricated cylindrical lithium ion batteries 22, and has gold plated contacts to insure long product life. The Li-ion cells 22 are manufactured using lithium ion polymer battery technology. The energy density of this battery is almost 20% higher than typical Li-ion cells and is 3 times more efficient than Nickel Cadmium (NiCd) or Nickel Metal Hydride (NiMH) cells. The voltage of the Li-poly cell ranges from 2.7VDC (discharged) to 4.23VDC (fully charged). The battery contains a monitor chip that switches the battery off when any of the series-connected cells falls below 3.0VDC, which allows the pack to be quickly recharged. The 15 cells provide a 54VDC supply at the nominal 3.6VDC. The battery packs 16 are keyed to allow being installed in only one way, preventing any chance of getting the polarity reversed. They can be swapped out in seconds so the drying process can be continued with a minimum of interruption. As battery technology advances, the battery packs will be supplied with the highest current capacity devices to improve the capability of the dryer.

As the hair dryer 10 uses a lot of power, the instant invention is supplied with 3 battery packs and a special charger that re-charges each battery in 15 minutes or less. The battery packs are keyed to allow being installed in only one way, preventing any chance of getting the polarity reversed. They can be swapped out in seconds so the drying process can be continued with a minimum of interruption. The handle is designed to provide an optimum balance when the battery pack is installed.

Figure 4:
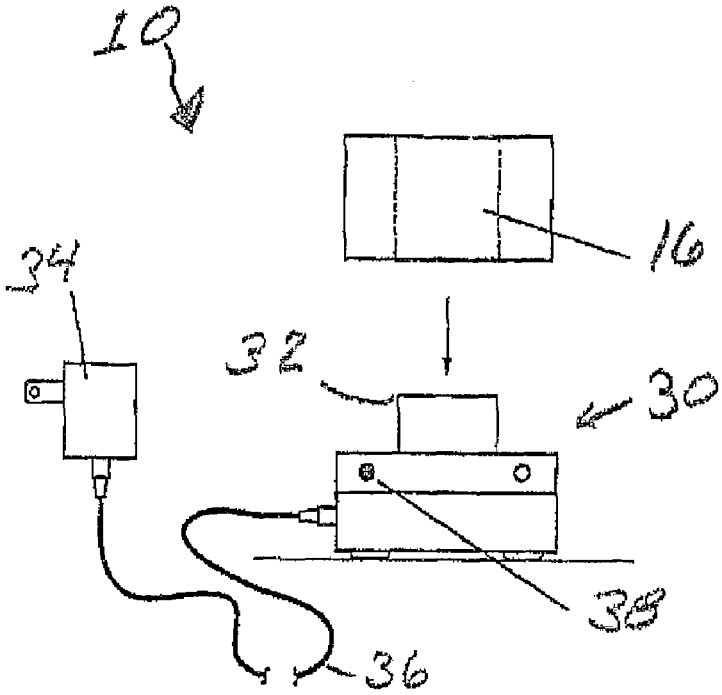
FIG. 4 is an elevational view of the preferred embodiment of the battery pack and charger of the cordless hair dryer device in accordance with the instant invention.

With reference to FIG. 4, the charger 30 comprises a battery pack mount 32, 120VAC to 54 VDC power adapter 34, cord 36 and LED's 38 on the front of the charger 30 to indicate when the battery pack 16 is charged. The controller 30 is microcomputer monitored and charges at three rates, while carefully monitoring the battery pack temperature. The 3-stage charging system provides maximum run time and extends the overall life of the battery. The 3 stages are:

Rapid start charge

Absorption charge

Top-off charge

This system is controlled to fully charge the batteries at the fastest and safest rate and to ensure the batteries never get 'overcharged' by limiting the charge to 42VDC per cell.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A cordless hair dryer device, said device comprising:

a housing having an air intake end and a cone shaped air nozzle that tapers toward an air outlet distal from said air intake end;

a blower fan supported in said housing;

a motor, supported in said housing, for rotating said blower fan;

a removable and rechargeable battery pack mountable to said housing and electrically communicated with said motor and said heater;

said air intake end defining a battery mount projecting outward from a back end of said housing for supporting said battery pack and electrically communicating said battery pack with said motor and said heater;

said battery pack defining a ring including a plurality of battery cells connected in series wherein said ring defines an central opening aligned with said air intake end and said ring fits around said battery mount;

means for controlling the speed of said motor; and means for controlling the temperature of said heater.

2. A device as recited in claim 1, further comprising:

a tourmaline impregnated ceramic heater supported in said housing in line with said air intake for preventing static charge.

3. A device as recited in claim 1, wherein said battery pack further comprises a monitor chip that switches the battery off when any of said battery cells fall below a predetermined voltage threshold.

4. A device as recited in claim 1, wherein said battery pack comprises gold plated contacts and contact moldings that snap into the ring housing to securely hold said battery pack.

5. A device as recited in claim 1, further comprising:

a battery charger adapted for releasably receiving said battery pack to recharge at least on of said battery cells, said charger having a microcontroller for charging at different rates and monitoring temperature of said battery pack to prevent overcharging.

6. A device as recited in claim 1, further comprising:

a handle projecting from said housing at a point that evenly balances the weight of said housing and the weight of said battery back of said hair dryer.

* * * * *